US005160531A

United States Patent [19]

Koizumi et al.

[11] Patent Number: 5,160,531

[45] Date of Patent: Nov. 3, 1992

[54] VACCUM REFINING METHOD UTILIZING INDUCTION HEATER AROUND A LADLE IN A VACUUM CONTAINER

[75] Inventors: Koreaki Koizumi, Tokai; Teruhiko So, Konan; Tetsuya Satio, Chita, all of Japan

[73] Assignee: Daido Tokushuko Kabushiki Kaisha, Japan

[21] Appl. No.: 795,837

[22] Filed: Nov. 21, 1991

[30] Foreign Application Priority Data

Nov. 30, 1990 [JP] Japan ..... 2-339101

[51] Int. Cl.[5] ..... C21C 7/10; C22B 4/00

[52] U.S. Cl. ..... 75/10.15; 266/207

[58] Field of Search ..... 266/207; 75/10.15

[56] References Cited

U.S. PATENT DOCUMENTS

| | | | |
|---|---|---|---|
| 3,185,565 | 5/1965 | Taylor | 75/10.15 |
| 4,743,302 | 5/1988 | Dumesnil et al. | 106/1.23 |
| 4,762,554 | 8/1988 | Lazcono-Navarro | 75/10.15 |
| 4,894,087 | 1/1990 | Finkl | 266/207 |
| 4,945,071 | 7/1990 | Friesen et al. | 501/41 |
| 5,013,697 | 5/1991 | Akhtar | 501/46 |

*Primary Examiner*—Peter D. Rosenberg

*Attorney, Agent, or Firm*—Parkhurst, Wendel & Rossi

[57] ABSTRACT

A vacuum refining method for refining a mass of molten metal which is obtained from a steel-making furnace or a steel-making secondary smelting furnace, which method includes the steps of: pouring the molten metal into a ladle; setting the ladle inside an induction heater which is provided in an enclosed container; evacuating the enclosed container; and induction-heating the molten metal in the ladle by the induction heater while the enclosed container is kept under vacuum, so as to refine the molten metal. An apparatus for practicing this refining method is also disclosed.

12 Claims, 2 Drawing Sheets

VACCUM REFINING METHOD UTILIZING INDUCTION HEATER AROUND A LADLE IN A VACUUM CONTAINER

BACKGROUND OF THE INVENTION

1. Field of the Invention

The present invention relates in general to a vacuum refining method which utilizes a ladel and an induction heating technique, and more particularly to such a vacuum ladle refining method suitable for refining a relatively small amount of molten metal, such as steel, special steel and stainless steel.

2. Discussion of the Prior Art

A conventional method for producing metals such as special steel includes a process of refining raw materials, such as a mass of molten metal obtained by melting a scrap in an arc furnace, or a mass of molten iron tapped from a blast furnace. While various methods have been proposed for the refining of the metals, these methods suffer from some problem as described below.

As one method using a fixed furnace, for example, there is known an AOD method for refining molten metal in air, with Ar gas and $O_2$, gas blown from the bottom of the furnace through the molten metal to be refined. There is also known a GRAF method, according to which a furnace body of the furnace is tilted after refining of the molten metal by electrode heating, so that a tuyere of the furnace is positioned under the surface of the molten metal, and Ar gas is blown through the tuyere into the molten metal. However, these methods are unsatisfactory in degrees of deoxidation and dehydrogenation and in removal of nonmetallic impurities. In addition, these methods using fixed furnaces need to use another ladle for transferring the refined molten metal to a location of casting. Thus, the molten metal tends to be affected by the air during its transfer into this ladle. Further, if only a small amount of molten metal is to be refined, the use of such a fixed furnace results in considerable deterioration in refining capability, and makes the refining apparatus comparatively large-sized in contrast to the amount of the molten metal. Moreover, since the refining temperature is elevated to a considerably high degree, refractories used for the fixed furnace should be highly resistant to heat.

In view of the above drawbacks, there is proposed another refining method called LF method, according to which a mass of molten metal is poured into a ladle, and then refined within the ladle. This LF method is advantageous in that the molten metal can be easily transferred to a location of casting without being largely affected by the air, and in that the molten metal can be refined into an extreme low oxygen steel, for example, without taking account of unfavorable influences on the components of the metals. To improve the quality of metals, there is further proposed a so-called VLF method (vacuum ladle refining method) as one method of refining a mass of molten metal under vacuum, outside of the furnace. According to this VLF method, the ladle which contains the molten metal is fluid-tightly closed by a top lid, and heating electrodes are inserted through the top lid into the ladle, so that the molten metal is heated by an electric arc generated by the electrodes, and thus slag-refined. Then, the electrodes are removed, and the top lid is replaced by another lid which permits degassing of the molten metal under vacuum. In this method, it is difficult to maintain a suitable degree of vacuum, since the ladle cannot be kept under vacuum during arc-heating, and the molten metal cannot be heated during degassing thereof. Therefore, the above method does not provide a sufficiently high degree of degassing effect. Further, this method requires two kinds of top lids so as to perform heating and degassing operations separately, resulting in a rather complicated refining process and an increase in the cost for preparing the refining apparatus including the ladle and the top lids.

As an alternative to the VLF method, it is proposed to employ an induction heating technique instead of the above-described electrode arc heating technique. According to the method utilizing the induction heating technique, a coil is disposed around a ladle which contains a mass of molten metal, and an electric power having a given frequency is supplied to the coil so as to heat the molten metal in the ladle by induced electric current. At the same time, an upper opening of the ladle is fluid-tightly closed by a top lid, and the air is sucked from the ladel so that the interior of the ladle is kept under vacuum. Thus, this method permits heating of the molten metal and evacuation of the ladle to be effected concurrently. However, ambient atmosphere is undesirably introduced into the ladel through its wall made of porous refractories, whereby the degree of vacuum in the ladle is reduced. Thus, it is difficult to keep the interior of the ladle in a highly evacuated condition.

SUMMARY OF THE INVENTION

It is accordingly an object of the present invention to provide a vacuum refining method for refining metals under a significantly improved degree of vacuum, to achieve improved degassing of metals, such as deoxidation and dehydrogenation, so as to meet severe requirements in recent years for high-quality metallic materials, and to provide such a method which requires a significantly reduced refining time, assuring high production efficiency.

The above object may be attained according to one aspect of the present invention, which provides a vacuum refining method for refining a mass of molten metal which is obtained from a steel-making furnace or a steel-making secondary smelting furnace, comprising the steps of: (a) pouring molten metal into a ladle; (b) setting the ladle inside an induction heater which is provided in an enclosed container; (c) evacuating the enclosed container; and (d) induction-heating the molten metal in the ladle by the induction heater while the enclosed container is kept under vacuum, so as to refine the molten metal.

According to the vacuum refining method of the present invention, the refining of the molten metal can be accomplished by heating the molten metal by induced electric current for a relatively short time, under a sufficiently high degree of vacuum established within the enclosed container in which the ladle is accommodated. Accordingly, degassing of the molten metal can be significantly enhanced, whereby a high-quality metallic material can be obtained with improved efficiency. Further, the amount of refining gas can be reduced according to the present refining method, as compared with the conventional AOD method, for example.

During the refining operation as described above, the molten metal may be stirred in the ladle by an induced electric current which is generated by the induction heater, and/or inert gas which is blown into the molten metal.

Further, a flux for making a slag and/or at least one alloy component may be added to the molten metal.

It is a second object of the present invention to provide an apparatus suitable for practicing the method of the invention.

The above second object may be attained according to another aspect of the present invention, which provides a vacuum refining apparatus for refining a mass of molten metal which is obtained from a steel-making furnace or a steel-making secondary smelting furnace, comprising: (a) a ladle for receiving the mass of molten metal; (b) an induction heater which is disposed around the ladle for heating the molten metal in the ladle by an induced electric current; (c) an enclosed container for accommodating therein the induction heater and the ladle; and (d) evacuating means for evacuating the enclosed container.

BRIEF DESCRIPTION OF THE DRAWINGS

The above and optional objects, features and advantages of the present invention will be better understood by reading the following detailed description of a presently preferred embodiment of the invention, when considered in connection with the accompanying drawings, in which.

DETAILED DESCRIPTION OF THE PREFERRED EMBODIMENT

Figure 1:
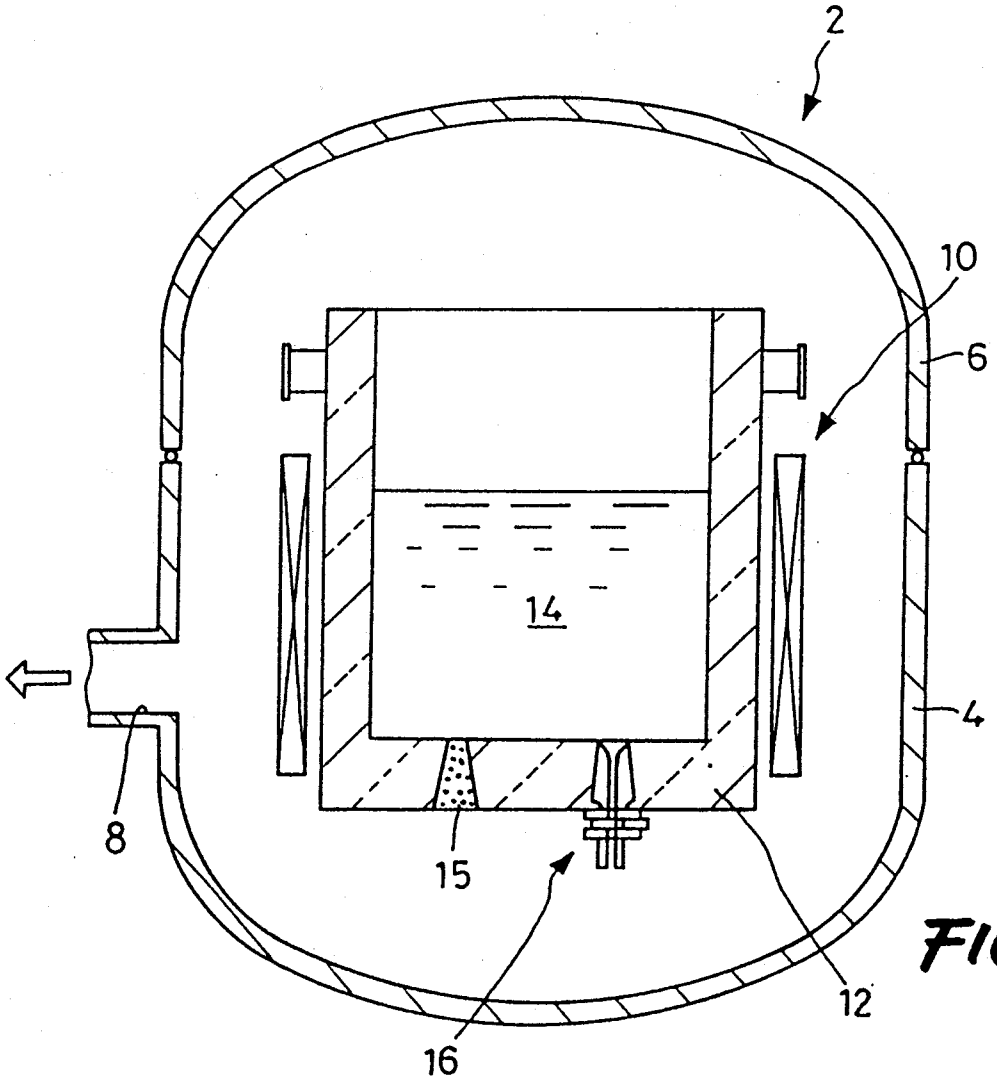
FIG. 1 is a schematic view in vertical cross section showing a vacuum refining apparatus using an induction heater disposed around a ladle, for refining molten metal according to a vacuum refining method of the invention.

Referring first to FIG. 1, there is schematically shown a vacuum refining apparatus which is suitably used for effecting the vacuum refining method according to the present invention.

In FIG. 1, reference numeral 2 denotes a vacuum container made of a suitable metallic material, which consists of a container body 4, and a removable lid member 6 for fluid-tightly closing an upper opening of the container body 4. The container body 4 is formed with a suction port 8 which is connected to a vacuum source such as a vacuum pump (not shown). By suitably controlling the vacuum source, the interior of the vacuum container 2 is kept under a desired degree of vacuum.

In the container body 4 of the vacuum container 2, there is fixedly installed an induction heater 10 in the form of a cylindrical coil made of a suitable material. This induction heater 10 is supplied through a power cable with an electric power having a predetermined frequency in a range of 10–100 Hz, so as to effect induction heating as described later. Within the diameter of the cylindrical coil of the induction heater 10, there is removably disposed a ladle 12 which is charged with a mass of molten metal 14 to be refined. The ladle 12 may be selected from various kinds of known ladles which are usually used for refining metals. In particular, an insulated segmented type ladle having a shell structure is preferably used to practice the principle of the present invention.

By using the thus constructed refining apparatus, a mass of molten metal is refined in the following manner according to the present invention. Initially, the molten metal 14 to be refined is poured into the ladle 12. The molten metal 14 is produced by melting metal in a steel-making furnace such as an ordinary arc furnace or AOD furnace, or in a steel-making secondary smelting furnace. Then, the lid member 6 of the vacuum container 2 is opened, and the ladle 12 is put into the vacuum container 2 such that the ladle 12 is located inside the diameter of the cylindrical coil of the induction heater 10 which is installed in place within the container 2.

Subsequently, the lid member 6 is closed so as to maintain the vacuum container 2 in an air-tight condition. Then, the air in the container 2 is sucked through the suction port 8, by means of an external vacuum pump or other vacuum source. Thus, the interior of the vacuum chamber 2 is vacuumized or evacuated, and kept under a suitable degree of vacuum. The degree of vacuum in the vacuum container 2 is appropriately selected within a range of about 0.1–10 Torr. In some cases, however, the degree of vacuum in the container 2 is favorably controlled to be 0.1 Torr or lower, in view of the properties of the molten steel to be refined. While the vacuum container 2 is kept under vacuum as described above, an electric power is supplied to the induction heater 10 so that the molten metal 14 in the ladle 12 is heated by induced electric current from the heater 10.

In the manner as described above, the molten metal 14 is vacuum degassed by simultaneously evacuating and heating the metal 14. During this degassification, the molten metal 14 may be advantageously stirred by induced electric current generated by the induction heater 10. Further, a suitable inert gas may be blown into the molten metal 14 as needed, through a porous plug 15 formed through the bottom wall of the ladle 12, so that the molten metal 14 is stirred by the inert gas. Moreover, flux for making slag, and/or an alloy component(s) may be added to the molten metal 14 as needed, the temperature of the molten metal 14 is adjusted. Thus, it is possible to effect vacuum slag refining of the molten metal 14, in which slag is produced as a result of the interaction of the added flux and impurities in the metal 14.

Subsequently, the ladle 12 which contains the thus refined molten metal 14 is taken out of the vacuum container 2, and transferred to a desired location of casting where the molten metal 14 is tapped out of the ladle 12, through a sliding nozzle 16 formed through the bottom wall of the ladle 12.

In the refining apparatus as described above, the ladle 12 which contains the molten metal 14 to be refined is accommodated in the vacuum container 2 which is held in a desired vacuum state. Therefore, the degree of vacuum of the atmosphere in the ladle 12 receiving the molten metal 14 may be easily controlled to a sufficiently high level. Further, since it takes a relatively short time to heat the molten metal 14 by the induction heater 10, it is possible to effectively reduce the refining time, while maintaining a sufficiently high level of degassing of the molten metal 14, such as deoxidation and dehydrogenation, until the melt 14 is tapped out of the ladle 12.

Furthermore, the vacuum refining as described above may be combined with the conventional AOD method. Where a SUS steel, for example, is refined first by the AOD method, and then by the instant vacuum refining method, the amount of Ar gas as a refining gas blown into the steel can be reduced, since the blowing of the Ar gas is required only during a reducing process following a decarbonizing or decarburizing process.

EXAMPLES

To clarify the principle of the present invention, there will be described some examples of vacuum refining according to the present invention. However, it is to be understood that the present invention is by no means limited to the details of these examples, but may be embodied with various changes, modification and improvements which may occur to those skilled in the art, in the light of the teachings contained herein.

EXAMPLE 1

A melt of five tons of SUS304 was prepared by an AOD furnace, and the obtained steel melt was refined under vacuum by the vacuum refining apparatus as illustrated in FIG. 1.

More specifically, after the mass of molten steel (14) was tapped out of the AOD furnace at 1650° C., and poured into the ladle (12), the ladle (12) receiving the molten steel (14) was set in position inside the cylindrical coil of the induction heater (10) installed in the vacuum container (2). Then, the container (2) was closed in a fluid-tight condition. Thereafter, the vacuum container (2) was evacuated by sucking the air in the container (2) through the suction port (8) by means of a vacuum pump. With the vacuum container (2) held under about 1.0 Torr of vacuum, electric power is supplied to the induction heater (10) so as to heat the molten steel (14) in the ladle (12) by induced electric current. At the same time, Ar gas was introduced into the molten steel (14) through the porous plug (15). In this manner, the molten steel (14) was refined for about 10 minutes.

Subsequently, the lid member (6) of the vacuum container (2) was opened, and the ladle (12) was taken out of the container (2). Then, the refined molten steel (14) in the ladle (12) was tapped at 1580° C. into a casting mold, to produce two ingots each weighing 2.5 tons. Thereafter, these ingots were hot-rolled into blooms, which were then rolled by a small rolling mill, so as to produce round steel bars having a diameter of 20 mm.

It was revealed in the above-described process that the unrefined molten steel which was tapped out of the AOD furnace contained 150 ppm of oxygen, whereas the round steel bars produced by refining the molten steel contained as low as 70 ppm of oxygen.

EXAMPLE 2

A melt of five tons of SCM415 was prepared by an AF furnace, and the obtained steel melt was refined under vacuum by the vacuum refining apparatus as illustrated in FIG. 1.

Initially, the molten steel (14) tapped out of the AF furnace at 1650° C. was poured into the ladle (12), and was induction-heated under about 1 Torr of vacuum within the vacuum container (2), in the same manner as in Example 1. In this example, flux such as CaO, $CaF_2$ and $Al_2O_3$ was added by 5-25 kg per ton of the molten steel (14) while being heated. Thus, the molten metal (14) was refined for about 20 minutes. Thereafter, the vacuum container (2) was opened, and the ladle (12) was taken out of the container (2). Then, the molten steel (14) was tapped out of the ladle (12) at 1640° C., and was cast into two ingots similar to those obtained in Example 1. These ingots were then hot-rolled into blooms, which were then rolled by a small rolling mill, so as to produce round steel bars having a diameter of 20 mm.

It was revealed in the above-described process that the unrefined molten metal tapped out of the AF furnace contained 150 ppm of oxygen, whereas the round steel bar contained as low as 30 ppm of oxygen, and that the unrefined molten metal tapped out of the AF furnace contained 5 ppm of hydrogen, whereas the round steel bars contained as low as 1.5 ppm of hydrogen.

EXAMPLE 3

There were prepared some specimens of molten steel (SNCM439) having various concentrations of oxygen. The molten steel of each specimen was heated under vacuum by the apparatus as shown in FIG. 1, so that vacuum slag refining of the steel was conducted at 1600° C. under 5 Torr of vacuum. Flux for yielding the slag was added by 20 kg per ton of the molten steel. The flux used in this example consists of CaO and $Al_2O_3$ whose ratio is 6:4.

Figure 2:
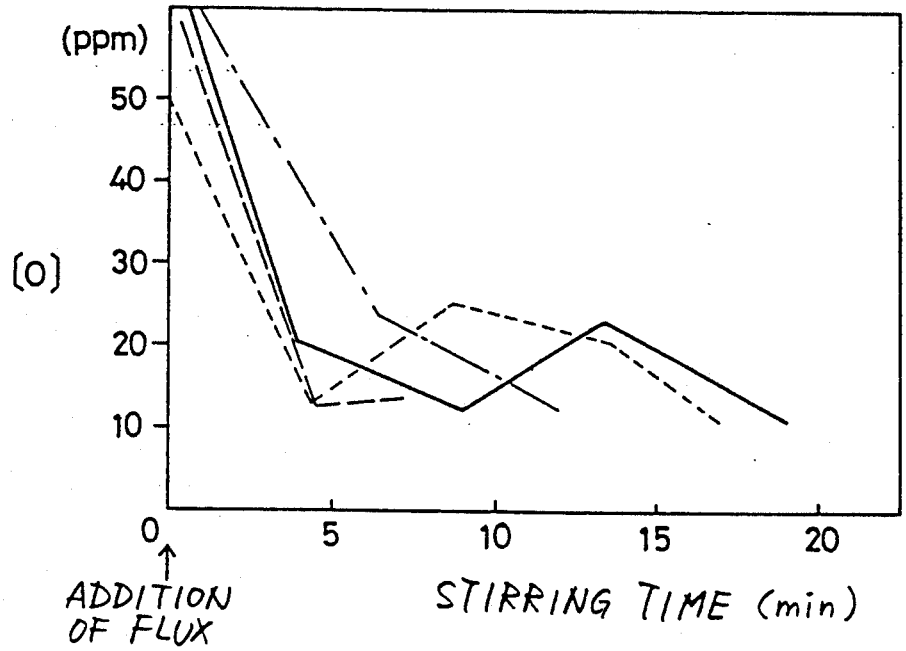
FIG. 2 is a graph showing a result of steel refining in Example 3.

It will be apparent from the result as shown in FIG. 2 that the concentration of oxygen in the molten steel was reduced to 15 ppm or lower, by stirring the molten steel for a considerably short period of time after the addition of the flux.

EXAMPLE 4

A mass of molten steel (SUS403) was heated under vacuum in the vacuum refining apparatus as shown in FIG. 1. Thus, the vacuum refining of the steel was effected at 1550° C. under 5 Torr of vacuum, with the molten steel stirred by bubbling of Ar gas as well as by induced electric current generated by the induction heater (10). The graph of FIG. 3 indicates the hydrogen concentration in the molten steel with respect to the vacuum refining time.

Figure 3:
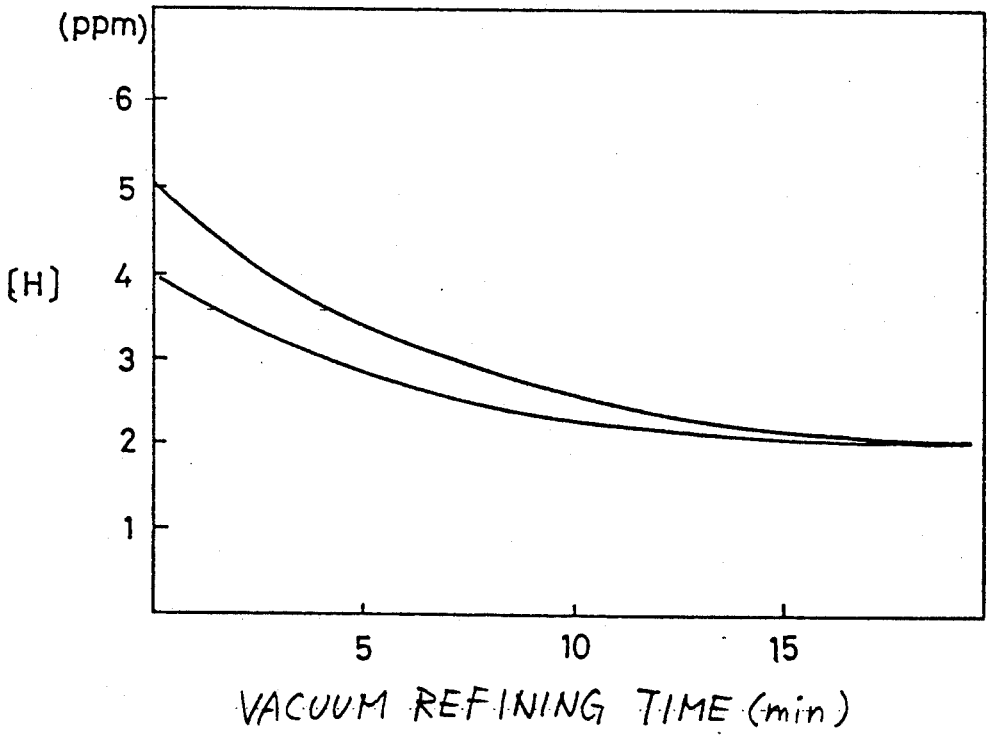
FIG. 3 is a graph showing a result of steel refining in Example 4.

It will be apparent from FIG. 3 that according to the vacuum refining method of the invention, the hydrogen concentration in the molten steel was reduced to 2.5 ppm or lower in considerably short period of time.

What is claimed is:

1. A vacuum refining method for refining a mass of molten metal which is obtained form a steel-making furnace or a steel-making secondary smelting furnace, comprising the steps of:

pouring said molten metal into a ladle;

introducing said ladle into an enclosed container such that said ladle is set inside an induction heater which is fixed in said enclosed container;

evacuating said enclosed container thereby creating a vacuum within said enclosed container;

induction-heating said molten metal in said ladle by said induction heater while said enclosed container is kept under vacuum, so as to produce a refined molten metal; and removing said ladle form said enclosed container, for pouring said refined molten metal into a casting mold outside said enclosed container.

2. A vacuum refining method according to claim 1, further comprising the step of stirring said molten metal in said ladle by an induced electric current which is generated by said induction heater.

3. A vacuum refining method according to claim 1, further comprising the step of stirring said molten metal in said ladle by inert gas which is blown into said molten metal.

4. A vacuum refining method according to claim 1, further comprising the step of stirring said molten metal in said ladle by an induced electric current which is generated by said induction heater, and inert gas which is blown into said molten metal.

5. A vacuum refining method according to claim 1, further comprising the step of adding a flux for making a slag to said molten metal.

6. A vacuum refining method according to claim 1, further comprising the step of adding at least one alloy component to said molten metal.

7. A vacuum refining method according to claim 1, further comprising the step of adding flux for making a slag and at least one alloy component to said molten metal.

8. A vacuum refining apparatus for refining a mass of molten metal which is obtained form a steel-making furnace or a steel-making secondary smelting furnace, comprising:

a ladle for receiving said mass of molten metal;

an enclosed container for accommodating therein said ladle;

an induction heater fixed in said enclosed container such that said ladle is movable into and out of said induction heater, said induction heater being separate from said ladle, said induction heater being operable for heating said molten metal in said ladle by an induced electric current, so as to produce a refined molten metal; and evaluating means for evacuating said enclosed container.

9. A vacuum refining apparatus according to claim 8, wherein said induction heater comprises a cylindrical coil which is supplied with an electric power to generate said induced electric current.

10. A vacuum refining apparatus according to claim 8, wherein said enclosed container consists of a container body having an opening, and a lid member for fluid-tightly closing said opening of said container body, said container body having a suction port through which air in said enclosed container is sucked by said evacuating means.

11. A vacuum refining apparatus according to claim 8, wherein said ladle has a porous plug formed through a bottom wall thereof, through which inert gas is blown into said molten metal.

12. A vacuum refining apparatus according to claim 8, wherein said evacuating means comprises a vacuum pump.

* * * * *